United States Patent [19]

Robinson

[11] 4,290,240

[45] Sep. 22, 1981

[54] AUTOMATIC EQUALIZER FOR ABRASIVE BELT

[76] Inventor: Charles E. Robinson, 208 Gardner Ave., Burlington, Wis. 53105

[21] Appl. No.: 116,068

[22] Filed: Jan. 28, 1980

[51] Int. Cl.[3] ..... B24B 21/00

[52] U.S. Cl. ..... 51/135 BT

[58] Field of Search ..... 51/135 BT, 135 R

[56] References Cited

U.S. PATENT DOCUMENTS 3,745,717 7/1973 Robinson ..... 51/135 BT 4,187,645 2/1980 Lind ..... 51/135 BT

FOREIGN PATENT DOCUMENTS 2709792 9/1978 Fed. Rep. of Germany ... 51/135 BT

*Primary Examiner*—Harold D. Whitehead

[57] ABSTRACT

An abrading belt runs on rolls one of which is on a yoke. A cylinder of a fluid actuator is fastened to the yoke and opposite sides of a piston in the cylinder are sequentially pressurized to cause the yoke to angulate back and forth for shifting the belt between lateral limits. A fluidic logic oscillator circuit is controlled by lateral limit sensors to switch the cylinder pressures. A lead screw couples the piston to a nominally fixed threaded element and a splined shaft connects the piston to a reversible motor. A time interval is initiated when the belt changes directions and if it expires before the next lateral limit is reached a signal is developed which causes the motor to shift the piston to thereby change the rocking angle of the yoke in one direction so the lateral travel times of the belt will become equal.

10 Claims, 1 Drawing Figure

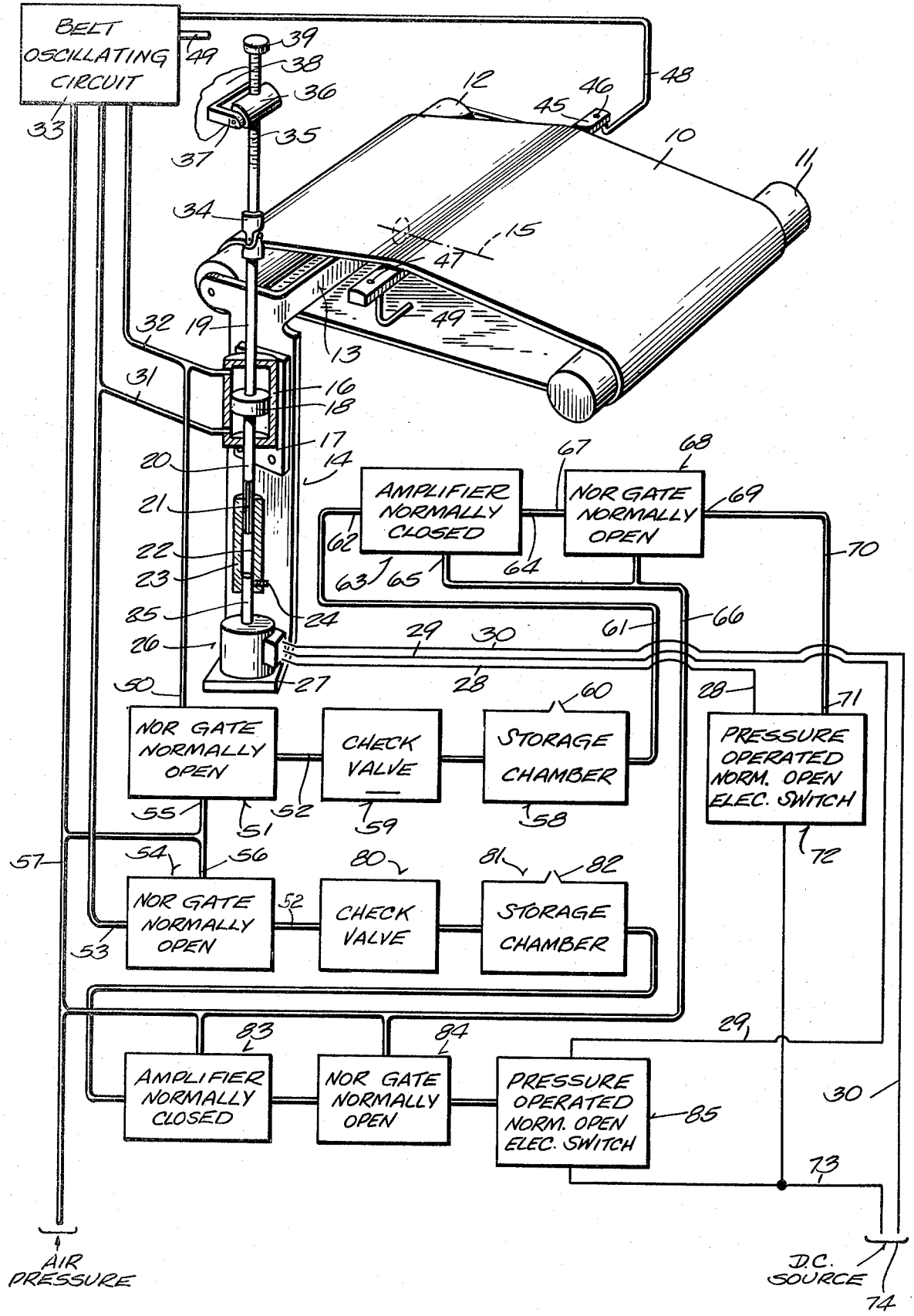
BELT OSCILLATING CIRCUIT
AMPLIFIER NORMALLY CLOSED
NOR GATE NORMALLY OPEN
NOR GATE NORMALLY OPEN
CHECK VALVE
STORAGE CHAMBER
PRESSURE OPERATED NORM. OPEN ELEC. SWITCH
NOR GATE NORMALLY OPEN
CHECK VALVE
STORAGE CHAMBER
AMPLIFIER NORMALLY CLOSED
NOR GATE NORMALLY OPEN
PRESSURE OPERATED NORM. OPEN ELEC. SWITCH
AIR PRESSURE
D.C. SOURCE

AUTOMATIC EQUALIZER FOR ABRASIVE BELT

This invention relates to an abrading machine of the type wherein a closed loop abrasive coated belt is oscillated back and forth laterally to the direction in which the belt is translated longitudinally while performing an abrading operation on a work piece.

The invention is particularly concerned with automatically equalizing the time intervals that elapse while the belt is being oscillated laterally in each direction.

A well-known purpose for oscillating the belt bilaterally is to obtain the smoother sanding or abrading that results when there is some relative lateral component of motion between the abrasive belt and the work piece, while steering the belt places it in the correct average position.

In abrading machines of this type, an abrasive belt runs on a pair of cylindrical rolls. One of the rolls is driven for translating the belt and another roll on which the belt runs may serve as an idler. The idler is mounted for being rocked through a small angle about an axis that is normal to the rotational axis of the roll. This causes the belt to shift back and forth laterally on the rolls so that the desirable lateral component of abrading is combined with the dominant longitudinal component. A fluidic circuit controlled steering and oscillating system for achieving bilateral belt motion is shown in U.S. Pat. No. 3,745,717 which is issued to the present applicant and is incorporated herein by reference.

Having a belt driving mechanism which produces lateral oscillations of constant amplitude does not necessarily result in the belt being moved at the same speed in opposite directions. The reason is that abrading belts often have nonuniform characteristics such as slightly different lengths as measured along their edges in the longitudinal direction and nonuniform tensile qualities across the width of the belt and belts may be affected unevenly by humidity changes. This results in variable internal stresses in the belt which cause it to move laterally at different speeds because in one direction the belt stresses may tend to assist lateral movement and in the other direction oppose it. The present invention is for assuring that the belt moves laterally in both directions in equal and constant time intervals. This negates the effects of permanent and temporary nonuniform characteristics and automatically trims the belt for ideal tracking behavior without operator intervention.

SUMMARY OF THE INVENTION

In accordance with a preferred embodiment of the invention, a fluidic logic oscillator and correction circuit determines if the time taken for the belt to be oscillated or moved to each lateral limit is greater than a predetermined time interval which is initiated coincidentally with a fluid driven oscillator receiving the beginning of a continuing signal to begin and maintain a belt oscillation in a lateral direction opposite to the direction of the next previous oscillation. If the predetermined time interval expires while the oscillation signal still endures for the same direction of oscillation, it means that the belt is moving toward its lateral limit too slowly in the direction being tested. The oscillator, which rocks one roll on which the belt runs through opposite angles to cause lateral belt shift, is then trimmed in response to the detected time error, to change the average tilt angle of the roll in the appropriate direction so opposite lateral movement times will be equal. The distance which the belt moves between limits is unchanged.

A detailed description of the new apparatus for compensating or equalizing the time which the abrasive belt spends oscillating in one lateral direction with the time that it spends oscillating in the other direction will be set forth in reference to the drawing.

DESCRIPTION OF THE DRAWING

The single FIGURE drawing is a schematic view of an abrading belt, its supporting rolls, sensing and control mechanism for driving the basic oscillator and the new additional controls for equalizing oscillation intervals.

DESCRIPTION OF A PREFERRED EMBODIMENT

In the drawing, an abrading machine to which the new control system is applicable comprises a closed loop belt 10 which runs on a cylindrical drive roll 11 and an idler roll 12. The drive mechanism for roll 11 is not shown. The belt opposite the side that runs on the rolls is coated with abrasive, and the lower run of the belt bears on a work piece, not shown.

Idler roll 12 is journaled for rotation on a yoke 13 which has an arm 14 extending from it. The yoke 13 and, hence, roll 12 are supported for oscillating or rocking, in a vertical plane as shown, about an axis represented by the dashed line 15. This axis is preferably perpendicular to the rotational axis of roll 12. A suitable structure for supporting the yoke 13 for rocking or oscillating through opposite angles may be seen in the above-cited U.S. Pat. No. 3,745,717.

To facilitate rocking roll 12 and to make belt 10 shift back and forth laterally on the rolls, arm 14 of the yoke carries an actuator including base 17 and cylinder 16 through which piston rods 19, 20 carrying piston 18 extends. A pneumatic system is preferred. The actuator 16–20 is of the double acting type. A pair of tubes 31 and 32 connect to opposite ends of the actuator cylinder 16 above and below the piston 18, as shown. These tubes are sequentially pressurized and depressurized for driving the actuator cylinder 16 in opposite directions with respect to piston 18 and connecting rod 19, 20 to make roll 12 oscillate about axis 15 in successively opposite angular directions. Thus, when driving roll 11 translates belt 10 longitudinally at high speed as it does during machine operation, the actuator slightly rocks yoke 13 and idler roll 12 about axis 15 to cause the belt to ride toward corresponding ends of the rolls 11 and 12 and then back toward opposite corresponding ends.

Piston 18 does not move to actuate belt oscillation but establishes a neutral position from which cylinder 16 moves to rock yoke 13 on axis 15. The position of piston 18 is adjusted to the correct neutral position by moving piston rod 19, 20. As illustrated, piston rod 19 is connected through universal joint 34 to lead screw 35 which is threaded through nut 36 gimballed on yoke 37 pivoted to a fixed surface 38. Preferably lead screw 35 also carries knob 39 for manual positioning. Turning lead screw 35 moves piston 18 axially to a new neutral position. Yoke 37 and universal joint 34 allow for movement of the parts to oscillate belt 10.

Automatic adjustment of the neutral position is accomplished by attaching reversible motor 26 to piston rod 20, for instance by a collar 23 which may have a splined connection 21, 22 to the piston rod and set screw 24 engaging motor shaft 25. Other appropriate connections may be used. Motor 26 is reversible and preferably electric with leads 28, 29 for current to drive it in respective directions of rotation and common line 30 to complete the connection to d.c. current source 74 as later described. Motor 26 is desirably supported on a base illustrated as 27 connected to arm 14.

The limits to which the belt is shifted laterally in each direction are established by use of a control bar 45 which has a curved upper surface on which the inside surface of belt 10 slides. The structural and functional details of control bar 45 are described in U.S. Pat. No. 3,745,717 and need not be repeated here. It is sufficient to point out that the control bar has one or more orifices such as those marked 46 and 47 at opposite ends. These orifices are used to interact with the timing circuit by initiating timing signals to determine the limits of belt movement in each lateral direction by beginning oscillation in the opposite direction. As explained in the patent, there are sensors or tubes 48, 49 in the control bar which have ports aligned with selected orifices 46 and 47. A segment is omitted in the drawing of sensor tubes 48, 49 for the sake of simplifying it. These sensors sense pressure changes when the orifices 46 and 47 are alternately covered and uncovered by one or the other of the belt edges. The sensed pressure signals are delivered in a known way to the previously mentioned known type of belt-oscillating fluidic circuit symbolized by the block which has that legend and the reference numeral 33. The belt oscillating circuit 33 responds to the signals from the sensors by applying fluid pressure to one side of the piston 18 through one of tubes 31 and 32 while pressure on the other side of the piston is relieved for the moment through the other such tube. Sensing pressure change at the sensor 48, 49 at the other end of bar 45 causes belt oscillating circuit 33 to switch the pressures in tubes 31, 32. This moves cylinder 16 and yoke 13, 14 on axis 15 in the oscillating mode.

The new control for equalizing the times for the belt 10 to travel between opposite fixed limits will now be considered in detail.

Equalization is obtained by employing two similar control loops described below and comprising fluidic logic elements in the preferred embodiment, to develop signals indicative of an error in lateral travel time for the belt, and then using the signals to trim the pneumatic oscillator so it will effect appropriate changes in the angles through which the yoke 13 and, hence, the roll 12 is tilted to bring about lateral travel time equality by the belt 10.

Considering one control loop first, NOR gate 51 transmits pressure to its output port 52 until the cylinder volume on one side of piston 18 is pressurized and this sustained pressure is received on the input port 50 of the NOR gate 51 at which time this NOR gate turns off and its output line 52 is unpressurized. The pressure present on the output port 52 of the gate 51 while it is turned on is transmitted to a storage chamber 58 through a check valve 59 which prevents reverse flow from the storage chamber back to NOR gate 51 when its output pressure is terminated. The storage chamber 58 has a controlled orifice 60 which allows fluid to bleed out of storage chamber 58 at a predetermined rate such that a time constant is determined which represents the elapsed time between fully pressurizing the storage chamber 58 and the time when discharge through the orifice 60 lowers the pressure in the chamber to a predetermined level. In other words, closure of the check valve 59 coincides with initiation of the measurement of the predetermined reference time interval and bleeding down to a predetermined minimum pressure coincides with the end of the time interval. The pressure condition in storage chamber 58 is transmitted through a tube 61 to the logic signal input port 62 of a fluid amplifier which is symbolized by the block marked 63.

Amplifier 63 has the previously mentioned signal pressure input port 62 and an output port 64. It also has a pressurized fluid supply input port 65 which is coupled by means of a header tube 66 to the source air pressure tube 57. An amplifier with suitable functional features is described in greater detail in the cited patent. The amplifier 63 is normally closed. A minimum pressure at 62 is required to trigger amplifier 63 to its conductive or open state. While storage chamber 58 is discharging down to the minimum triggering pressure for the amplifier 63, a signal is thus passing through the amplifier to its output port 64 which is coupled to the input port 67 of another normally open NOR gate represented by the block 68. When storage chamber 58 has discharged to a pressure below the triggering pressure of the amplifier 63, a signal to the NOR gate 68 input port 67 no longer exists, so NOR gate 68 turns on or begins to conduct, pressurizing output port 69. Output port 69 of NOR gate 68 is coupled by means of a tube 70 to the input port 71 of a pressure controlled electric switch 72. This switch has a set of contacts, not visible, which are open when there is no pressure on its input port 71 and which close in response to pressure on its input port. The switch (and corresponding switch 85 in the second loop) has a d.c. input line 73, and has the previously mentioned output line 28 which is one of the inputs to reversible trimming motor 26. The motor is supplied through the contacts of pressure operated switch 72 from a d.c. source indicated by the reference numeral 74. The other source line is the previously mentioned common line 30 to the windings of reversible motor 26. Thus, when the contacts of pressure operated switch 72 close, a circuit is completed through motor 26 and it runs slowly in one direction to trim the neutral position of the oscillator actuator by moving piston rod 19, 20, carrying piston 18, to a new axial position by means of parts 34–39.

If the pressure that is supplied to oscillator cylinder 16 until the belt reaches a lateral limit and to the input port 50 of the first NOR gate 51 disappears because the limit is reached while the storage device 58 is timing out, the first NOR gate 51 will change state and a new charge of pressure will be supplied to storage chamber 58. In such case, there will be no change of state on the input 62 of amplifier 63 nor to the input port 67 of the last NOR gate 68 in the first control loop in which case pressure responsive switch 72 will not be operated and motor 26 will not run to trim the oscillator piston 18 neutral position.

Whenever the time for a full lateral oscillation of belt 10 exceeds the predetermined reference time interval set by discharge rate or time constant of storage device 58, the tilt angle for steering roll 12 on axis 15 will be changed in the direction that will result in the belt taking less time and, in effect a constant time to reach its limit in the one lateral direction to which the control loop relates.

Stated in another way, the storage device 58 provides a predetermined time interval with which the signal to cylinder 16 for oscillation of the belt in one direction is compared. If the oscillator input signal to one side of piston 18 is too long, the storage device 58 will have timed out while the oscillation signal still continues, and the motor 26 will be driven in a direction which will slowly change the roll 12 oscillation or tilt angle. If the signal from oscillation circuit 33 to the oscillator cylinder 16 prevails for a time which is too short, no change in the first control loop which is now under consideration will be made since the input port 50 to the first NOR gate 51 will go low earlier and storage device 58 will be quickly recharged to full pressure in which case the pressure operated switch 72 will not be operated.

The second control loop constantly tests and corrects any error in belt travel time in the other lateral direction and comprises a first previously mentioned NOR gate 54 port 52, a check valve 80, a storage chamber device 81 having a timing orifice 82, an amplifier 83, a second NOR gate 84 and a pressure operated switch 85, all comparable to like parts in the first control loop. The input port 53 of the first NOR gate 54 in the second control loop receives a signal comparable to the signal provided to the lower side of the piston 18 in cylinder 16 when the oscillator circuit triggers the oscillator to angulate the roll 12 to an opposite angle so the belt 10 will shift toward the other lateral limit. The pressure operated switch 85 also has a set of normally open contacts, not visible, in circuit with the d.c. supply line 73 coming from d.c. source 74. The switch has previously mentioned output line 29 which runs to a second input of reversible motor 26. When the contacts in pressure operated switch 85 close, a circuit is completed through electric line 29 and the common return line 30 to d.c. source 74. This drives motor 26 in the opposite direction from which it is driven when the contacts of pressure switch 72 in the first control loop are closed. When pressure switch 85 closes its contact, motor 26 turns piston rod 19, 20 carrying lead screw 35 in a direction which moves actuator piston 18 to change the roll 12 angulation for obtaining a lateral belt oscillation which does not exceed the predetermined reference time interval set by the discharge time of the second storage device 81. The orifice 82 of storage device 81 and the orifice 60 of the other storage device 58 are adjusted or chosen so that the respective storage devices will produce an identical predetermined time interval. Thus, they will always cause an adjustment of the actuator piston which will restore the signals for oscillation from oscillating circuit 33 to the actuator toward durations equal to the predetermined time. Hence, regardless of the abrasive belt 10 tending to use more time to move in one direction than in the other for any reason, the oscillation times will always be automatically set toward equality.

The belt travel time equalizing system described above can be simplified in the interest of reducing costs by substituting visual displays, such as indicator lamps, not shown, for the oscillation time trimming or correcting motor 26. In other words, instead of having the motor run, lamps could be connected between d.c. correction signal output line 29 and the common line 30 and line 28 and common 30, which would provide the machine attendant with a visual indication that the oscillation times in each direction had been indicated by the two control loops to be unequalized. A simple pneumatic indicator could replace the electric circuit. A manual correction could then be made such as by manually turning trimming lead screw 35 to adjust the position of the actuator piston 18. Other mechanical adustment means could also be used.

Another alternative is to use a pneumatic motor, not shown, in place of reversible motor 26. However, an electric motor is preferred because pneumatic motors tend to require too much air volume and too much air pressure to operate reliably. A rotatable electric motor 26 and a lead screw 35 are preferred as compared with other means for trimming the adjustment of the actuator cylinder stroke and, hence, the angles through which the yoke 13 oscillates, because a screw gives a very rigid adjustment and provides a solid base for operation of the actuator which causes the belt 10 to oscillate. A motor driven screw also makes the system more immune to errors which might result from inherent vibrations of the machine.

The idea of checking the time of each lateral belt oscillation and providing an oscillator trimming signal to obtain time equalization can, of course, be implemented in ways other than by what is contemplated to be the preferred way as described herein. For example, instead of referencing the durations of the oscillator drive signals from oscillating circuit 33 for alternate oscillations against a fixed predetermined time intervals independent of each other, signals equivalent to the successive signals to the first NOR gates in the loop could be stored for one oscillation cycle. Pairs of alternate signals could then be compared using programmable processors to produce an error or difference signal and using appropriate output devices to control a compensating servo motor to run in a direction depending on the positive or negative magnitude of the error signal.

It will be appreciated that in actual operation of the abrading machine, it is desirable to check the time of each lateral shift by the belt as described herein, but adjusting the neutral position of piston 18 for every oscillation cycle will not ordinarily be necessary. It is primarily a matter of correcting for drift in belt oscillation speed and moving the angulation equilibrium of the yoke. Hence, a relatively low speed trimming motor 26 can be used.

It will also be evident that the illustrative pneumatic logic devices in the individual control loops could be implemented with digital electronic logic devices. For instance, an electronic logic NOR gate could be substituted for fluidic NOR gate 51 whose output 52 goes low when its control signal input 50 goes high. An electric signal corresponding with the oscillator driving pressure signal on input line 50 to the first NOR gate could be replaced by a pressure responsive switch, not shown, in line 50 and having the output of this switch constitute one logic input to an electronic NOR gate. A diode, not shown, would be the analog of check valve 59. A capacitor and a resistor, not shown, for providing an RC time constant, would be analogs of storage device 58 and its bleeder orifice 60, respectively. An electronic amplifier could e substituted for pneumatic amplifier 63 and an electronic logic NOR gate, not shown, could be substituted for pneumatic NOR gate 68. In an electronic logic system, of course, a relay or controlled rectifier could be used in place of pressure responsive switch 72.

Although a fluidic logic system using two control loops for equalizing oscillation time of an abrasive belt has been described in considerable detail, such description is intended to be illustrative rather than limiting, for the invention may be variously embodied and is to be limited only by interpretation of the claims which follow.

I claim:

1. In an abrading machine including an endless belt supported for translating longitudinally on spaced apart rolls, oscillator means coupled to at least one of said rolls for oscillating said roll through opposite angles to cause said belt to move back and forth laterally on said rolls, means responsive to said belt reaching a predetermined limit of lateral movement in one direction by providing alternate signals for controlling said oscillator to move said belt in an opposite direction to another predetermined lateral limit, the travel times of said belt in opposite directions being subject to variations due to indeterminate characteristics of the belt, and the improvement comprising:

means for determining the time that it takes for said belt to move from one lateral limit to the other latera limit under the influence of said oscillator means, and means for adjusting said oscillator means to change the angles through which it oscillates said roll to thereby equalize said times.

2. The machine as in claim 1 including motor means responsive to the difference in said times by adjusting said oscillator means to effect said changes in its oscillation times.

3. In an abrading machine including an endless belt supported for translating longitudinally on spaced apart rolls, oscillator means for oscillating at least one of said rolls through opposite angles about an axis that is substantially normal to the rotational axis of said roll to cause said belt to move back and forth laterally on said rolls, means responsive to said belt reaching a predetermined limit in one lateral direction by providing a signal for controlling said oscillator means to oscillate said belt toward the limit in the opposite lateral direction, the improvement comprising:

means for controlling said oscillator means to alter the opposite angles, respectively, through which said oscillator oscillates said roll to thereby vary the lateral movement speed of said belt, means for initiating a reference time interval coincident with occurrence of each oscillator control signal, and means responsive to said oscillator control signal enduring for a time that differs from said reference time interval by providing an indicating signal which indicates that said difference exists, to thereby enable controlling said oscillator to alter one or another of said angles until no substantial difference exists.

4. The machine as in claim 3 wherein:

said oscillator means comprises a cylinder having a piston therein, and said control signals for said oscillator effect pressurizing opposite sides of said piston alternately with a fluid medium, means supporting said one roll for rotation and for oscillating through said angles, means operatively coupling said cylinder with said supporting means, said means for controlling said oscillator means to alter said angle comprising motor means coupled to said piston and operative to move said piston axially and thereby alter said angles in response to occurrence of said indicating signal.

5. The machine as in claim 4 wherein:

said motor means is a reversible electric motor, first and second electric switch means operating respectively, in response to indicating signals occurring within the times that the respective control signals exist and causing said motor means to run in a direction required to reduce said difference in time.

6. The machine as in claim 3 wherein:

said reference time interval initiating means are in respective control loops each of which comprises:

logic gate means having input and output means and responsive to a high logic level signal being applied to its input means by producing a low logic level signal on its output means, means for coupling the signal for causing said oscillator to angulate said roll in one direction to the input of said logic gate means, said time interval initiating means including a storage device coupled to the output means of said gate means and operative to develop and store a predetermined high level signal while the high logic level signal is applied to the input means of said logic gate means, said time interval initiating means also including means for beginning to reduce said stored signal to a predetermined lower level as a function of time coincident with termination of the high logic level signal to said logic gate means and coincident with said oscillator means terminating angulation of said roll in one and the other respectively, of the opposite angular directions, and means that are nonresponsive as long as said stored signal is restored to said predetermined high level in correspondence with occurrence of the next control signal before expiration of said interval as defined by said predetermined lower signal being reached, said last name means responding to said interval expiring by producing an output signal, said control means responding to occurrence of said output signal by controlling said oscillator to alter an angle to thereby increase the speed of lateral movement of said belt for the direction that enabled said interval to expire.

7. In an abrading machine including an endless belt translatable longitudinally on spaced apart rolls, means for supporting at least one of said rolls for rotation and for being angulated through opposite angles about a longitudinal axis that is generally perpendicular to the rotation axis of said one roll, a fluid cylinder and a piston therein one of which is operatively coupled to said support means for oscillating said one roll through opposite angles to cause said belt to move back and forth laterally on said rolls between limits, means responsive to said belt reaching a predetermined lateral limit in one direction by supplying fluid pressure to said cylinder on the proper side of said piston and for a time period that ends when said belt reaches the limit in the opposite direction, the travel times of said belt in opposite directions being subject to variations due to indeterminate characteristics of the belt, the improvement for equalizing the travel times comprising:

reversible motor means operative to change the relative position between said cylinder and piston to thereby alter said angles for equalizing said belt travel times, a pair of control loops each of which has a first fluidic logic NOR gate having input and output means, said input means being coupled respectively to said cylinder on opposite sides of said piston for sensing the alternate applications of fluid pressure to the opposite sides of the piston, said gate means being operative to provide logic low fluid pressure on its output means when logic high pressure is provided to its input means and to provide logic high pressure on its output means when in the absence of pressure on its input means, respective fluid pressure storage chambers having input and output means and means for controlling the rate of discharge from said storage chambers to establish a predetermined reference time interval that begins when a chamber is first charged with pressure to a predetermined high level and that expires when said chamber has discharged to a predetermained low level, check valve means respectively interposed between the output means of said first fluidic gate means and the input means of said chamber for enabling fluid pressure to be delivered to said chamber while said gate means output is high in the absence of pressure on the gate means input means and for preventing back flow when said gate means output means goes low during the presence of pressure for causing an oscillation when said gate means input means is held at a logic high level, respective means for producing an output signal in response to said chambers discharging to said high level upon occurrence of the next charge of fluid for oscillating to the side of said piston to which said gate means input means is coupled, and respective means responsive to occurrence of output signals by causing said motor means to effect said altering of said relative positions of said piston to thereby alter the oscillation angle for the direction of oscillation in which said reference time interval expired.

8. The machine as in claim 7 wherein:

said reversible motor means is an electric motor controlled by said output signal, a lead screw turned by said motor means and operatively engaged with said pistons for moving said piston in opposed directions in correspondence with the direction in which said motor turns.

9. The machine as in claim 7 wherein:

said reversible motor means is an electric motor, said respective means for producing output signals comprising fluid amplifier means having input and output means, said input means being coupled to the output means of said storage chamber, said amplifier means responding to a pressure signal from said storage chamber which is above said predetermined low logic level by providing a high pressure signal on its output means and responding to a pressure above said low level by not providing said high pressure signal, respective second NOR gate means having input means coupled to the output means of said amplifier and having output means, the output means of said second NOR gate means being switched to a logic high pressure state signal in response to a low level signal from said amplifier means, and respective pressure responsive switch means and an electric source in circuit with said motor means, said switch means responding to said high level signals from said second NOR gate means by causing said motor to drive said lead screw to change the positional relationship between said cylinder and piston.

10. In an abrading machine having an endless belt supported for translating longitudinally on spaced apart rolls, means supporting one of said rolls for rotation and for rocking through opposite angles about an axis that is substantially perpendicular to the rotational axis of said one roll to thereby cause said belt to move laterally back and forth on said rolls, a fluid-operated actuator including a cylinder part and a piston part therein, one of said parts being normally stationary and the other being reciprocable relative to the stationary part and the reciprocable part being coupled to said roll supporting means to rock it through said opposite angles in response to reciprocations, means for alternately fluid pressurizing and depressurizing said cylinder on opposite sides of said piston to effect reciprocations for rocking said roll through successively opposite angles, means for causing said last named means to switch the fluid pressure from one side to the other of said piston each time opposite edges of said belt reach predetermined lateral limits, the travel time of said belt between said limits being subject to variations due to indeterminate characteristics of said belt, and the improvement for equalizing the travel times of said belt in both directions, comprising:

first and second means for determining reference time intervals that begin coincident with pressure being introduced respectively on one side and the other side of said piston for rocking said roll supporting means in said opposite angular directions, motor means for changing the position of said normally stationary actuator part relative to said reciprocable part, and means responsive to either of said reference time intervals expiring by causing said motor means to change the position of said normally stationary part relative to said reciprocable part to thereby alter the angles through which said roll is rocked and hence the speed at which said belt travels laterally.

* * * * *